US007014480B1

(12) United States Patent
Weidner et al.

(10) Patent No.: US 7,014,480 B1
(45) Date of Patent: Mar. 21, 2006

(54) GROUNDING METHODS AND APPARATUS FOR CONNECTOR ASSEMBLIES

(75) Inventors: Kevin Edward Weidner, Hummelstown, PA (US); Shawn William Burkholder, Harrisburg, PA (US); Michael J. Block, Carlisle, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/057,974

(22) Filed: Feb. 15, 2005

(51) Int. Cl.
*H01R 4/66* (2006.01)

(52) U.S. Cl. ..... 439/95; 439/939; 439/63

(58) Field of Classification Search ..... 439/95, 439/92, 939, 581, 582, 63
See application file for complete search history.

(56) References Cited

U.S. PATENT DOCUMENTS

| | | | | |
|---|---|---|---|---|
| 4,113,333 | A * | 9/1978 | Horowitz | 439/97 |
| 4,291,930 | A * | 9/1981 | Landgreen | 439/97 |
| 4,738,628 | A * | 4/1988 | Rees | 439/95 |
| 4,934,960 | A * | 6/1990 | Capp et al. | 439/620 |
| 5,108,300 | A * | 4/1992 | Weber | 439/188 |
| 5,145,412 | A * | 9/1992 | Tan et al. | 439/620 |
| 5,326,280 | A * | 7/1994 | Briones et al. | 439/581 |
| 6,036,545 | A | 3/2000 | Caviness et al. | |
| 6,109,936 | A | 8/2000 | Tan et al. | |
| 6,164,986 | A | 12/2000 | Frantz et al. | |
| 6,168,448 | B1 * | 1/2001 | Chang | 439/188 |
| 6,503,106 | B1 * | 1/2003 | Suzuki | 439/669 |
| 6,780,051 | B1 | 8/2004 | Otsu | |

* cited by examiner

*Primary Examiner*—Gary Paumen

(57) ABSTRACT

A grounding clip for an electrical connector having an insulative housing and a connector shell includes a base configured to engage a first outer surface of the insulative housing, and a collar extending from the base and engaging a second outer surface of the insulative housing. The collar includes at least one grounding tab extending therefrom. A conductive insert engages the connector shell and the base.

8 Claims, 5 Drawing Sheets

GROUNDING METHODS AND APPARATUS FOR CONNECTOR ASSEMBLIES

BACKGROUND OF THE INVENTION

This invention relates generally to electrical connectors, and more particularly, to electrical connectors having an electrical connection to system panel or earth ground.

In the past, connectors have been proposed for interconnecting electrical components such as coaxial cables and/or circuit boards. Generally, coaxial cables have a circular geometry formed with a central conductor having one or more conductive wires surrounded by a cable dielectric material. The dielectric material is surrounded by a cable braid that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by connector assemblies, or when the coaxial cable is connected to a connector assembly for use with a circuit board, it is preferable that the impedance remain matched through the interconnection.

Today, coaxial cables are widely used. Demand has increased for radio frequency (RF) transmission via coaxial cables and circuit boards in, for example, automotive and telecommunications applications. The increased demand for RF transmissions in these industries is due in part to the advancements made in the electrical content within various equipment, such as audio systems, cellular phones, GPS, satellite radios, Blue Tooth™ compatibility systems and the like. The wide applicability of coaxial transmission systems demands that connected coaxial cables maintain the impedance at the interconnection.

In some coaxial transmission applications, it is also preferable to match an RF signal ground to panel, or earth, ground. Consequently, when sections of coaxial cable and/or circuit boards are interconnected by connector assemblies, it is preferable that the ground signal of the assembly be electrically common with panel and/or earth ground. For grounding purposes conventional coaxial connector assemblies include a conductive connector shell matable with the coaxial cable shield or circuit board ground. At least one known connector assembly includes a fully metalized connector shell. The metalized connector shell is coupled to panel or earth ground, thereby allowing the signal ground to be electrically common with panel of earth ground. However, having a metalized connector shell increases the overall weight of the connector, and increases the thermal mass of the connector making it more difficult to solder onto a circuit board. Additionally, the metalized connector shell increases the cost of production and increases the cost of assembly.

At least one other known connector assembly includes a plastic connector housing surrounding a portion of the conductive connector shell. A metal tab is coupled to the plastic connector housing and extends through the rear portion of the connector shell to form a conductive path therebetween. A jumper wire engages a distal end of the tab and is connected to panel ground, thereby allowing the signal ground to be electrically common with earth ground. However, such connector assemblies have increased assembly costs associated with coupling the tab to the housing and coupling the jumper wires to the tab.

BRIEF DESCRIPTION OF THE INVENTION

According to an exemplary embodiment, a grounding clip for an electrical connector including an insulative housing and a connector shell is provided. The grounding clip includes a base configured to engage a first outer surface of the insulative housing, and a collar extending from the base and engaging a second outer surface of the insulative housing. The collar includes at least one grounding tab extending therefrom. A conductive insert engages the connector shell and the base.

Optionally, the insert be separately provided from and independently mounted to the clip. In one embodiment, the insulative housing includes an opening extending therethrough, and the insert includes a plurality of fins configured to retain the insert within the opening. The insert may include a pin extending through an opening in the base. Optionally, the base may include a deflective arm extending from the base to engage a third outer surface of the insulative housing, or the base may include a pair of resilient arms extending from the base and engaging opposed outer surfaces of the insulative housing.

According to another embodiment, an electrical connector includes a center conductor, a dielectric insert surrounding the center conductor, a connector shell surrounding the dielectric insert, and an insulative housing surrounding the connector shell and having an opening extending therethrough in communication with the connector shell. A clip includes a base extending over the opening in the insulative housing, a pair of arms extending from the base along opposed outer surfaces of the insulative housing, and a collar extending perpendicularly from the base and including a grounding portion. The base is electrically coupled to the connector shell.

According to a further embodiment, an electrical connector assembly includes a connector shell surrounding a contact cavity, a contact extending from the contact cavity and engaging a circuit board, an electrically grounded clip separated from the connector shell by an insulative housing, and a conductive insert extending through the insulative housing. The insert engages each of the clip and the connector shell, thereby forming a direct conductive path between the connector shell and the grounded clip.

DETAILED DESCRIPTION OF THE INVENTION

Figure 1:
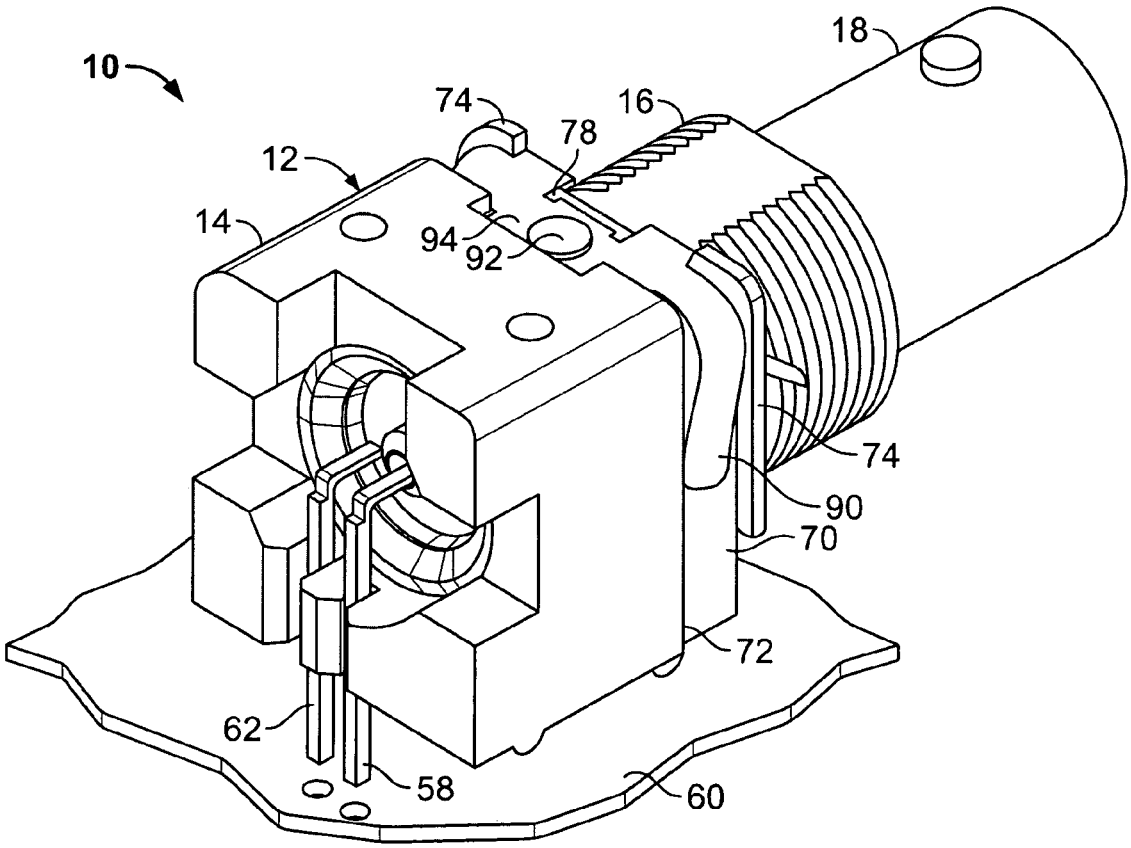
FIG. 1 is a perspective view of a connector formed in accordance with an exemplary embodiment of the present invention.
Figure 2:
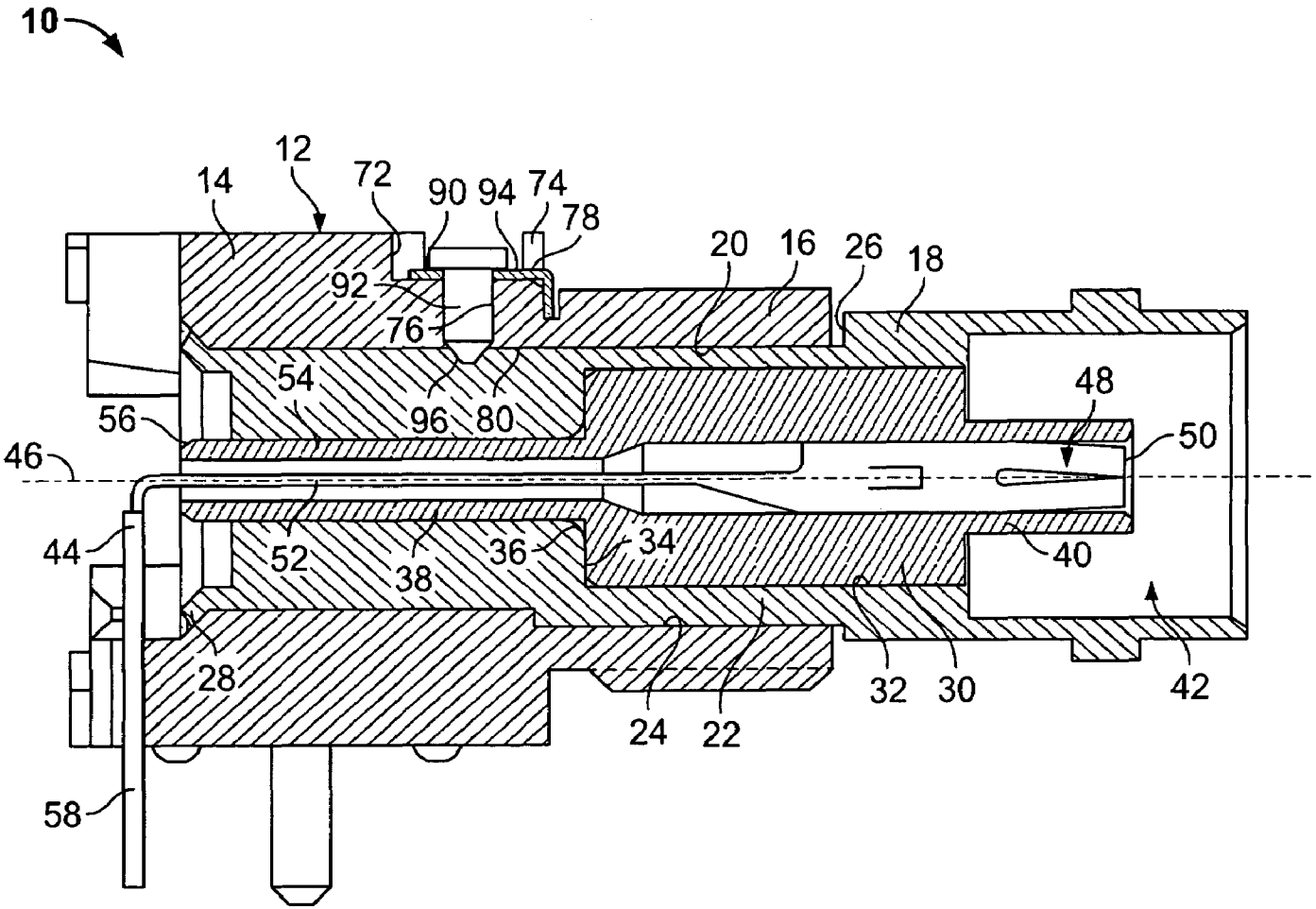
FIG. 2 is a cross-sectional view of the connector shown in FIG. 1.

FIG. 1 is a perspective view of a connector 10 formed in accordance with an exemplary embodiment of the present invention. FIG. 2 is a cross-sectional view of the connector 10 having a fabricated body or housing 12, such as by injection molding with plastic, where such body 12 includes a rear portion 14, having a generally rectangular profile, a mid portion 16 integrally molded to the rear portion, and a forward conductive connector shell portion 18, a construction generally known in the art for connectors such as radio frequency (RF) coaxial cable connectors. A plug assembly (not shown), such as an RF coaxial cable connector, may be mechanically and electrically coupled to the connector shell portion 18.

The rear portion 14 and mid portion 16 define an insulative housing of the connector 10 and include a central bore 20 into which the connector shell portion 18 is received. To secure the respective portions into an integral unit, an external projecting key 22 of the shell portion 18 extends along a keyway 24 in the mid portion 16. Relative movement of the shell 18 is prevented by a rear facing shoulder 26 of the shell 18 that faces the mid portion 16. Movement of the shell is also prevented by a thin flange 28 of a rear end of the shell 18 engaging against a molded countersink end of the bore 20. The flange 28 may be outwardly flared after insertion into the bore 20 to engage the insulative housing.

Within the connector shell portion 18, there is provided a hollow insulative liner, or dielectric, 30 for the shell portion 18 which extends within an axial, stepped cylindrical passage 32. An external step shoulder 34 of the liner 30 engages an interior, forward facing, step shoulder 36 of the shell portion 18. A rear portion 38 of the liner 30 is of reduced diameter and projects concentrically into the rear end of the connector 10. Additionally a front portion 40 of the liner 30 is of reduced diameter and projects concentrically into a disconnect coupling portion 42 of the shell portion 18.

A conductive electrical contact 44, referred to as a center contact, extends concentrically within the liner 30 along a longitudinal axis 46 of the connector 10. A unitary, disconnect contact portion 48 includes a hollow cylindrical electrical receptacle. An open end 50 of the contact portion 48 faces forward toward the disconnect coupling portion 42 and is concentrically within the liner 30. An elongated portion 52 of the contact 44 extends concentrically along a reduced diameter portion 54 of the liner 30 and projects beyond an end 56 of the liner 30 to provide an electrical terminal 58, bent 90 degrees, for pluggable receipt into a device 60, such as a circuit board. Additionally, a grounding post 62 extends from the rear end of the shell 18 and is bent 90 degrees for pluggable receipt into the planar electronic device 60.

The rear portion 14, as best illustrated in FIG. 1, is generally of a rectangular shape, with a groove 70, or reduced cross sectional area, about the forward portion thereof. The groove 70 is defined by a rear shoulder 72 and forward panel stops 74. Additionally, the forward panel stops 74 define a keying feature therebetween. The groove 70 includes an opening 76, as best illustrated in FIG. 2, extending completely through the insulative housing from an outer surface 78 to an inner surface 80 thereof. In the illustrated embodiment, the opening 76 extends through the rear portion 14 of the insulative housing.

In an exemplary embodiment, a grounding clip 90 is secured to the insulative housing within the groove 70. Specifically, the grounding clip 90 is positioned over the opening 76, and a conductive insert or pin 92 extends through the clip 90 and opening 76 to secure the clip 90 to the insulative housing. In one embodiment, the insert 92 may be a screw for securing the clip 90 to the insulative housing. In an alternative embodiment, the clip 90 and the insert 92 may be unitarily formed and fabricated from a single piece of metal. As illustrated in FIG. 2, the insert 92 engages the outer surface 94 of the clip 90 and also engages an outer surface 96 of the connector shell portion 18. As such, a direct conductive path is defined between the shell portion 18 and the grounding clip 90. Moreover, the insert 92 and thus the grounding clip 90 are electrically common with the connector shell portion 18.

Figure 3:
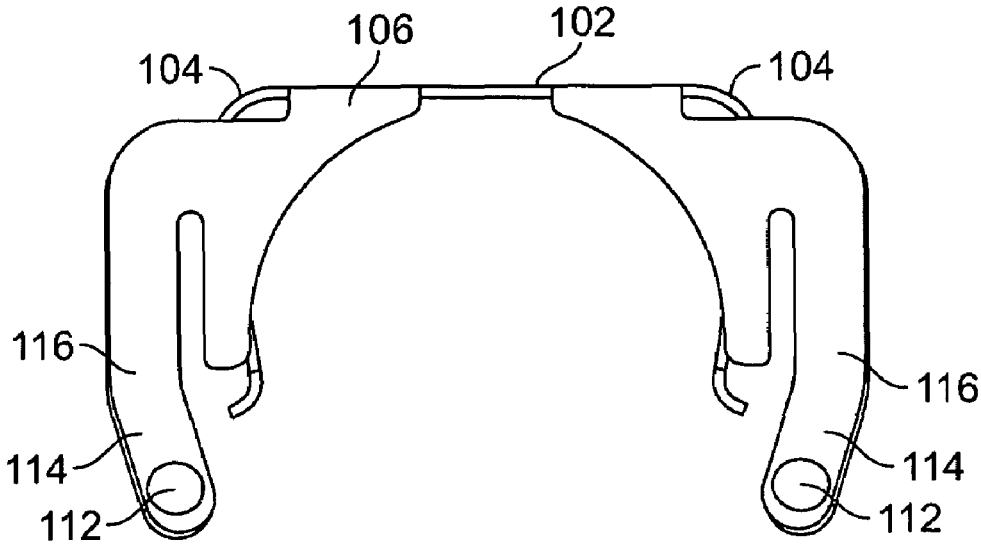
FIG. 3 is a front view of an exemplary grounding clip used in the connector shown in FIGS. 1 and 2.
Figure 4:
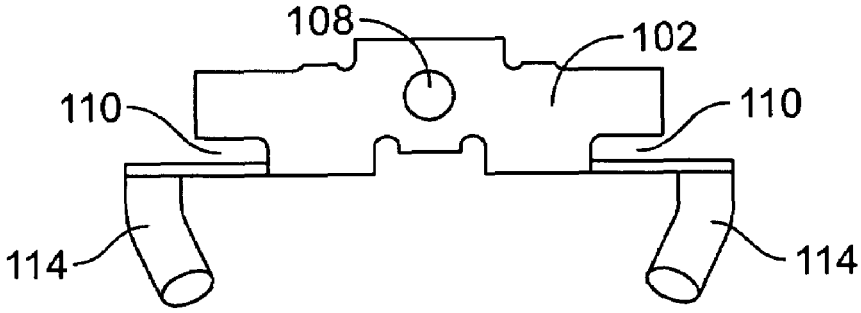
FIG. 4 is a top view of the grounding clip shown in FIG. 3.
Figure 5:
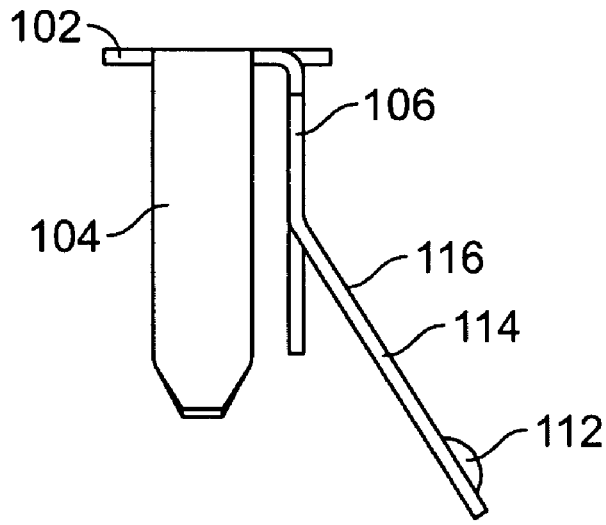
FIG. 5 is a side view of the grounding clip shown in FIGS. 3 and 4.

FIG. 3 is a front view of an exemplary grounding clip 90 for the connector 10 (shown in FIGS. 1 and 2), FIG. 4 is a top view of the grounding clip 90, and FIG. 5 is a side view of the grounding clip 90. The clip 90 is formed from a flat metal blank and includes a base 102 and resilient, spaced apart arms 104 inclined toward one another. The arms 104 extend generally perpendicularly with respect to the base 102 and may be deflected to frictionally engage the outer surface 78 of the insulative housing when mounted to the connector 10. In one embodiment, the base 102 defines an upper surface of the clip 90 and the arms 104 define side surfaces of the clip 90, as the clip 90 is oriented with respect to the connector 10. Additionally, the clip 90 includes a collar 106 extending generally perpendicularly with respect to the base 102. In one embodiment, the collar 106 defines a forward surface of the clip 90, as the clip 90 is oriented with respect to the connector 10. However, as will be realized by those in the art, the clip 90 may have various alternative configurations and the clip 90 illustrated in the figures is provided as an exemplary embodiment.

The base 102 includes an opening 108 extending therethrough. The opening 108 is oriented to substantially align with the opening 76 (shown in FIG. 2) as will be describe in detail below. Additionally, the base 102 may include a plurality of keying slots 110. The keying slots 110 are sized and shaped to engage the forward panel stops 74 (shown in FIG. 1) and the base 102 is oriented to extend through the keying feature defined between the forward panel stops 74. As a result, the clip 90 may be contained in position by the keying slots 110 and keying feature of the connector 10.

The clip 90 includes a grounding portion 112. In the illustrated embodiment, the grounding portion 112 is positioned on grounding tabs 114 extending from opposite edges of the collar 106. Alternatively, the grounding tabs 114 may extend from the base 102. In the exemplary embodiment, the grounding tabs 114 have a forward facing mounting surface 116. The grounding tabs 114 extend obliquely with respect to the collar 106, and the grounding portion 112 is positioned at a distal end of the tabs 114. In one embodiment, the tabs 114 engage an earth grounded mounting panel (riot shown). Specifically, the connector 10 may be coupled to the mounting panel such that the grounding portions 112 of the grounding tabs 114 mechanically and electrically engage the mounting panel. In one embodiment, the grounding tabs 114 may be resiliently engaged to the mounting panel such that the tabs 114 are deflected when the connector 10 is coupled to the mounting panel. As a result, the grounding clip 90 may be electrically common with the mounting panel, and particularly, may be earth grounded. Alternatively, the grounding portion 112 may be electrically coupled to another grounded component.

Figure 6:
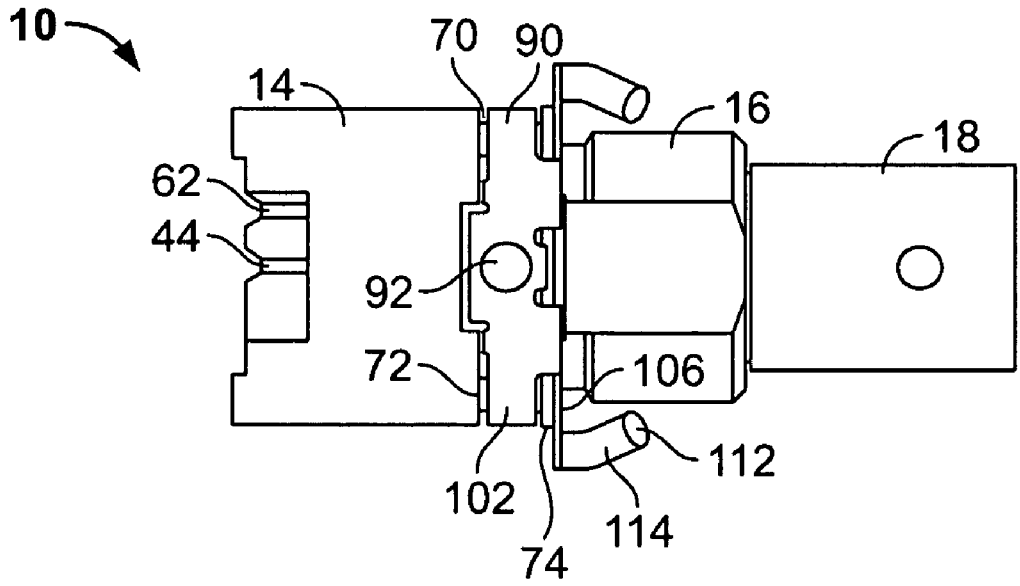
FIG. 6 is a top view of the connector shown in FIGS. 1 and 2.
Figure 7:
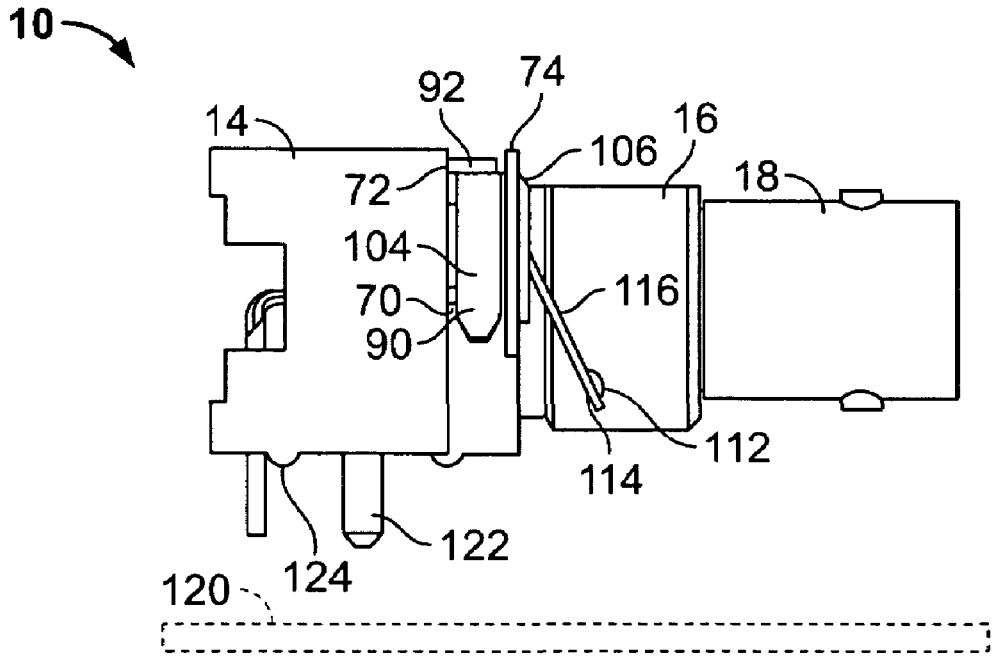
FIG. 7 is a side view of the connector shown in FIGS. 1 and 2.

FIGS. 6 and 7 are top and side views, respectively, of the connector 10, illustrating the orientation of the clip 90 with respect to the connector 10. Additionally, the connector 10 is oriented for mounting to a circuit board 120 along a lower portion of the connector 10. Specifically, the electrical contact 44 and grounding post 62 extend below the lower portion of the connector 10 for mating with the circuit board 120. Additionally, mounting posts 122 extend below the lower portion for mating with the circuit board 120. Stand offs 124 may also extend from the lower portion to position the connector 10 with respect to the circuit board 120.

The clip 90 is mounted to the connector 10 such that the base 102 and the arms 104 extend within the groove 70. In the illustrated embodiment, the base 102 extends along the upper surface of the groove 70 between the rear shoulder 72 and forward panel stops 74 and the arms 104 extend along the side walls of the groove 70 between the rear shoulder 72 and forward panel stops 74. The collar 106 extends along the forward face of the rear portion 14 and along the forward face of the panel stops 74. As a result, the collar 106 extends perpendicularly with respect to each of the base 102 and the arms 104. The grounding tabs 114 extend obliquely from the collar 106 in a generally forward direction and are oriented to engage a grounded component, such as a mounting panel (not shown).

The insert 92 secures the clip 90 to the insulative housing. Specifically, the insert 92 extends through the substantially aligned openings 76 and 108 (shown in FIGS. 2 and 5, respectively) of the insulative housing and the clip 90, respectively.

Figure 8:
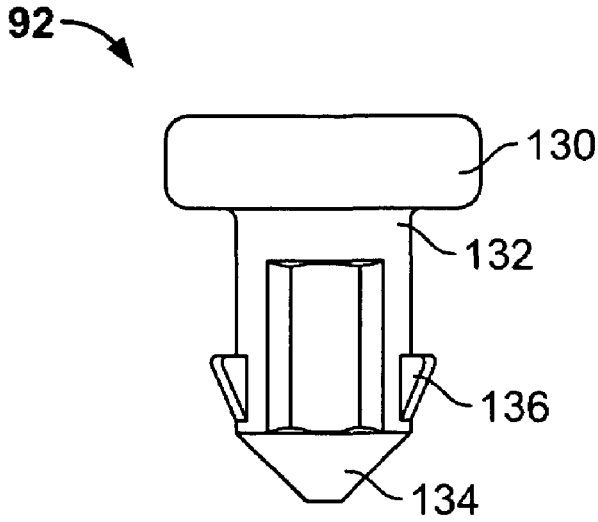
FIG. 8 is a side view of an exemplary insert used in the connector shown in FIGS. 1 and 2.

FIG. 8 is a side view of an exemplary insert 92 used in the connector 10. The insert 92 includes a head 130 and a body 132 extending from an outer surface of the head 130. A portion of the body 132 defines a connector shell engagement section 134 oriented to engage the connector shell portion 18 (shown in FIG. 2). The insert 92 may be unitarily formed from a conductive material. The insert 92 includes a plurality of fins or barbs 136 extending from the body 132. The fins 136 engage the insulative housing when the insert 92 is positioned within the opening 76, as generally described above. Thus, the fins 136 secure the insert 92 to the insulative housing and in contact with the connector shell portion 18 and the clip 90 (shown in FIG. 2).

An electrical connector 10 is thus provided in a cost effective and reliable manner. The connector 10 includes an insulative housing surrounding a connector shell portion 18. In use, an assembly such as an RF coaxial cable may be coupled to the connector shell portion 18. The connector 10 also includes a grounding clip 90 coupled to earth ground and partially surrounding the insulative housing. An insert 92 engages the grounding clip 90, extends through the insulative housing, and also engages the shell portion 18. As a result, a direct conductive path is defined between the shell portion 18 and the grounding clip 90. Accordingly, the connector 10 allows the shell portion 18 and the grounding clip 90 to be electrically common in a cost effective and reliable manner. Specifically, by using a housing fabricated from an insulative material, such as a plastic, as opposed to a metalized connector housing used in at least some known connector assemblies, the weight of the connector 10 and the cost of the connector 10 is reduced. Additionally, the connector 10 may be easier to handle during assembly, thus decreasing assembly costs. Moreover, in contrast to some known connector assembly that utilize jumper wires to ground the connector assembly, the use of a grounding clip 90 as described above may decrease the component cost and the assembly costs of the connector 10 and provide a more reliable connector 10.

While the invention has been described in terms of various specific embodiments, those skilled in the art will recognize that the invention can be practiced with modification within the spirit and scope of the claims.

What is claimed is:

1. An electrical connector comprising:

a center conductor;

a dielectric insert surrounding the center conductor;

a connector shell surrounding the dielectric insert;

an insulative housing surrounding said connector shell and comprising an opening extending therethrough in communication with said connector shell;

a clip comprising a base having an opening aligned with the opening in said insulative housing, a pair of arms extending from the base along opposed outer surfaces of the insulative housing, and a collar extending perpendicularly from said base and including a grounding portion; and an electrically conductive insert extending through the opening in said base and the opening in said insulative housing and contacting said connector shell, wherein said base is electrically coupled to said connector shell.

2. An electrical connector in accordance with claim 1 wherein said connector shell defines a signal ground of said electrical connector, and said clip is coupled to earth ground thereby allowing the signal ground to be electrically common with the earth ground.

3. An electrical connector in accordance with claim 1 wherein said clip comprises at least one grounding tab, said grounding tab comprising the grounding portion.

4. An electrical connector in accordance with claim 1 wherein said grounding portion is configured to engage an electrically grounded mounting panel.

5. An electrical connector in accordance with claim 1 wherein said insulative housing comprises a keying slot along an exterior surface thereof, said base extending through said keying slot for restricting movement thereof.

6. An electrical connector comprising:

a connector shell surrounding a contact cavity;

a contact extending from said contact cavity and configured for engaging a circuit board;

an electrically grounded clip separated from said connector shell by an insulative housing; and a conductive insert extending through said insulative housing and engaging each of said clip and said connector shell, wherein said insulative housing has an opening extending therethrough, said clip has an opening substantially aligned with the opening in said insulative housing, and said insert extends through the opening in said clip and the opening in said insulative housing and contacts said connector shell, thereby forming a direct conductive path between said connector shell and said clip.

7. An electrical connector in accordance with claim 6 wherein said connector shell defines a signal ground of said electrical connector, and said clip is coupled to earth ground thereby allowing the signal ground to be electrically common with the earth ground.

8. An electrical connector in accordance with claim 6 wherein said clip comprises a base engaging a first outer surface of the insulative housing, a collar extending from said base and engaging a second outer surface of the insulative housing, and at least one grounding tab extending from said clip.

* * * * *